United States Patent [19]

Inoue et al.

[11] Patent Number: 4,470,479

[45] Date of Patent: Sep. 11, 1984

[54] METHOD OF MAKING METAL COATED FOIL SPEAKER DIAPHRAGM

[75] Inventors: Hideaki Inoue, Neyagawa; Hiroshi Takeuchi, Matsubara; Hidetsugu Kawabata, Hirakata; Keizo Ishiwatari, Kobe, all of Japan

[73] Assignee: Matsushita Electric Industrial Co., Ltd., Kadoma, Japan

[21] Appl. No.: 108,158

[22] Filed: Dec. 28, 1979

Related U.S. Application Data

[62] Division of Ser. No. 781,002, Mar. 24, 1977, abandoned.

[51] Int. Cl.[3] ..... G10K 13/00; H04R 7/00

[52] U.S. Cl. ..... 181/168; 204/192 C; 204/192 N; 427/209; 427/248.1; 427/309; 427/405; 427/409; 427/410; 428/457

[58] Field of Search ..... 427/248.1, 255.7, 309, 427/209, 327, 405, DIG. 10, 409, 410, 156; 428/538, 457; 181/170, 167, 168; 179/181 R; 29/594, 169.5; 204/192 C, 192 N

[56] References Cited

U.S. PATENT DOCUMENTS

| | | | |
|---|---|---|---|
| 638,246 | 12/1899 | Husted et al. | 181/168 |
| 2,484,519 | 10/1949 | Martin | 427/DIG. 10 |
| 2,528,454 | 10/1950 | Schlesinger et al. | 427/248.1 |
| 2,984,605 | 5/1961 | Cooper | 427/DIG. 10 |
| 3,443,983 | 5/1969 | Golding et al. | 427/410 |
| 3,499,799 | 3/1970 | Patterson | 427/405 |
| 3,702,261 | 11/1972 | Feakes et al. | 427/DIG. 10 |
| 3,712,798 | 1/1973 | Van Thyne et al. | 427/405 |
| 3,811,930 | 5/1974 | Kuehl et al. | 427/DIG. 10 |
| 4,135,601 | 1/1979 | Tsukagoshi et al. | 181/167 |

FOREIGN PATENT DOCUMENTS

| | | | |
|---|---|---|---|
| 2106103 | 9/1972 | Fed. Rep. of Germany | 427/255.7 |
| 1314676 | 4/1973 | United Kingdom | 427/248.1 |

*Primary Examiner*—Sadie L. Childs

*Attorney, Agent, or Firm*—Cushmam, Darby & Cushman

[57] ABSTRACT

A speaker diaphragm of the present invention is prepared in a manner such that a boron layer is formed on one face of a dome-shaped metal foil by means of a physical vapor deposition method such as ion-plating, cathode sputtering, vacuum evaporation or the like, when necessary the metal foil is thinned by etching, and then, if necessary, another boron layer is formed on the other face of the metal foil. Alternatively, a metal layer is formed on the surface of the boron layer. The resultant speaker diaphragm is light in weight and high in modulus and also has appropriate internal mechanical resistance against vibration, thereby providing a speaker of high efficiency and satisfactory characteristics.

28 Claims, 16 Drawing Figures

METHOD OF MAKING METAL COATED FOIL SPEAKER DIAPHRAGM

CROSS-REFERENCE TO RELATED APPLICATIONS

This application is a division of our earlier application Ser. No. 781,002 filed Mar. 24, 1977, and now abandoned.

BACKGROUND OF THE INVENTION

The present invention relates to a speaker diaphragm using a metal foil such as titanium, aluminium or the like as a substrate thereof, which diaphragm is especially suitable for a tweeter, and a method of making the same.

Hitherto, a product of natural fiber such as pulp, form-forming (blown) high polymer resin, high polymer resin film, metal foil or the like have been used as a materials for speaker diaphragms. However, these are not necessarily satisfactory as diaphragm materials for the following reasons: Diaphragms using a natural fiber product have disadvantages that they are inefficient because of their small specific modulus and are readily influenced by humidity or temperature; although they have an advantage that no adverse sharp resonation occurs during operation because they have appropriate internal mechanical resistance, i.e., attenuation caused by friction among the fibers. Diaphragms using metal foils have the disadvantage that a sharp resonation occurs therein because of their low internal mechanical resistance and a strain appears because of their non-linear motion when amplitude of vibration is great; although they are good in efficiency because they have a relatively high specific modulus and not influenced by humidity or temperature.

It is generally known that for a suitable diaphragm, materials having a high specific modulus, light weight and appropriate internal mechanical resistance are suitable. It has been difficult to provide diaphragms satisfying the abovementioned incompatible characteristics by using existing materials only for the diaphragms.

Although titanium and aluminium, which are generally employed as a metal materials for speaker diaphragms, are mechanically strong and have relatively high specific modulus, that is the ratio of Young's Modulus to the density (e.g. $2.3\text{–}2.7\times10^{11}$ (cm/sec)$^2$), yet, in order to obtain a good efficient speaker, diaphragm materials of a much higher specific modulus are required.

SUMMARY OF THE DISCLOSURE

The present invention discloses a speaker diaphragm light in weight, having a high specific modulus and an appropriate internal mechanical resistance, by forming at least one boron layer on the face(s) of a metal foil made of titanium, aluminium or the like, and to provide a method of making such a speaker diaphragm comprising the layer of boron, which is frangile compared with metals and difficult to machine though having a hardness next to diamond and excellent in specific modulus.

BRIEF DESCRIPTION EXPLANATION OF THE DRAWINGS

FIGS. 1A–1C, 2A–2D, 3A–3D, and 4A–4D are cross-sectional views showing the manufacturing steps of a first, a second, a third, and a fourth embodiment, respectively, of the speaker diaphragm of the present invention.

FIG. 5 is a cross-sectional view of another embodiment of the speaker diaphragm of the present invention.

DETAILED DESCRIPTION OF THE PREFERRED EMBODIMENT

In the present invention, a metal foil such as aluminium, titanium, copper or the like shaped, for example in a dome or hemisphere, is employed as the substrate of a diaphragm, and boron is applied on the surface of the substrate by a physical vapor deposition method (e.g. ion-plating, cathode sputtering, vacuum evaporation or the like). One characteristic of the present invention is that, such a composite diaphragm is then etched by chemical etching using various kinds of etching solutions or an ion etching method, to thin the metal foil, thereby achieving higher specific modulus ($E/\rho$) as well as lighter weight (where $\rho$ indicates density and E indicates Young's modulus). Since the boron has such low density of 2.3–2.47 g/cm$^3$ and such high specific modulus of $16.3\times10^{11}$ (cm/sec)$^2$, the resultant composite diaphragm consisting principally of the boron layer performs well and exhibits satisfactory characteristics.

Preferred examples of the present invention are elucidated hereinafter referring to the accompanying drawings.

Example 1

Figure 1:
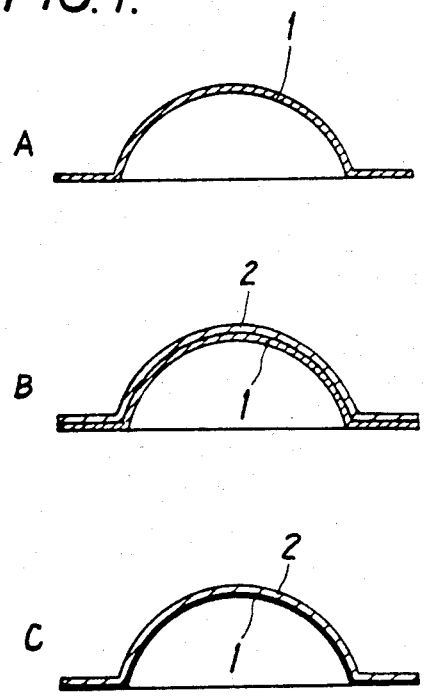

First, as shown in FIG. 1A, a metal foil 1 of about 10 $\mu$m in thickness such as aluminium, titanium, copper or the like is formed into a dome-shape. Then, as shown in FIG. 1B, on a surface of said metal foil 1, a boron layer 2 of at least 10 microns in thickness is formed by means of a physical vapor deposition method such as ion-plating, cathode sputtering, vacuum evaportaion or the like method. Finally, the metal foil 1 is etched by chemical etching using etching various solutions (e.g. containing 10% of NaOH for aluminium foil, 10% of HF for titanium foil and $HNO_3$ for copper foil) or by cathode sputter etching, to be thinned to a predetermined amount of approximately 1–3 microns in thickness. In this manner a diaphragm for speakers as shown in FIG. 1C can be produced.

Example 2

Figure 2:
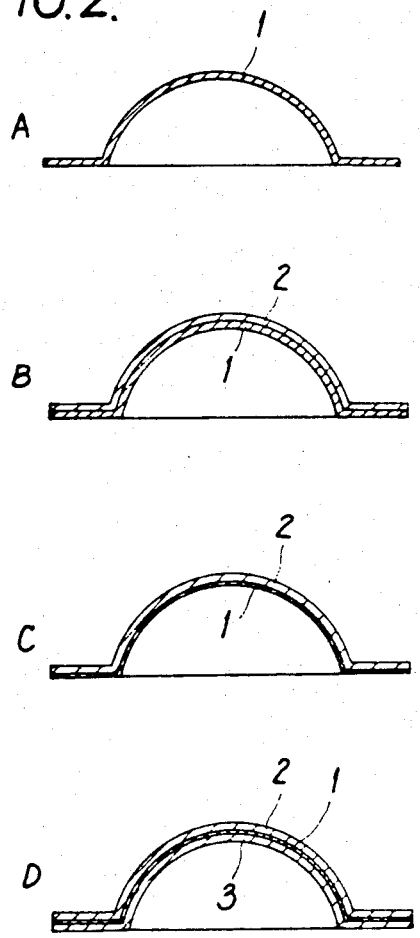

A composite diaphragm shown in FIG. 2C is manufactured using the same processes as in Example 1 (FIGS. 1A–1C). Then, on the rear face of metal foil 1 of said composite diaphragm, another boron layer 3 of at least 10 microns in thickness is further formed as shown in FIG. 2D to obtain a diaphragm for speakers.

According to the itching process as described in the above-mentioned Examples 1 and 2 (FIGS. 1 and 2), the metal foil 1 can be satisfactorily thinned to an extent of 1 to 3 microns in thickness, thereby reducing weight of the diaphragm and improving efficiency.

Example 3

A metal foil 1 is first formed into a dome-shape as shown in FIG. 3A, and then thinned, as shown in FIG. 3B, to approxiamtely 5–6 microns in thickness by a chemical (non-electrolysis) etching method. Finally, as shown in FIG. 3C a boron layer 2 is formed of at least 10 microns in thickness on the surface of the metal foil 1 to obtain a speaker diaphragm. Alternatively, another boron layer 3 can be formed on the rear face of the metal foil 1 in addition to the front surface, to obtain a speaker diaphragm.

Figure 3:
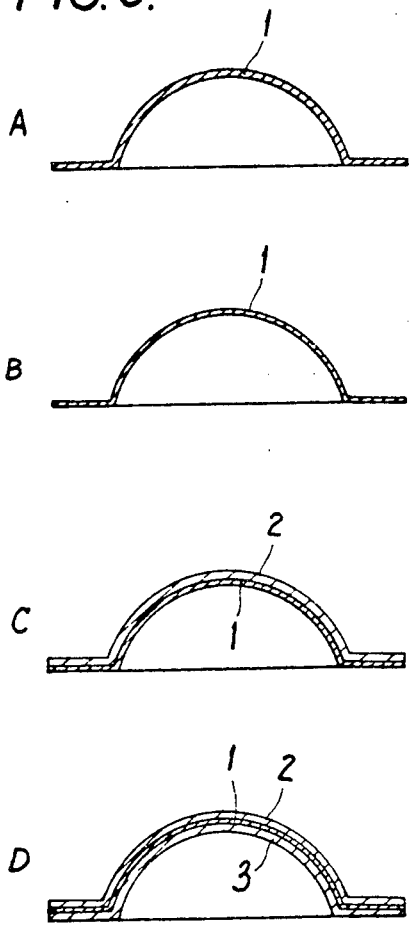

According to the process shown in FIG. 3, though there is a problem that the metal foil 1 can not be made sufficiently thin because of the etching made without any support by the boron layer, there is an advantage in that the boron layers 2 and 3 are strongly combined with the metal foil 1 because the whole face(s) of metal foil 1 is (are) roughened by the etching.

Table 1 shows densities as well as specific moduli of the speaker diaphragms of the abovementioned examples of the present invention, and of the prior art. The specific moduli of the diaphragms of the examples of the present invention are calculated considering each composite diaphragm as a single-layered body.

TABLE 1

| Components | | | |
|---|---|---|---|
| Thickness of Metal Foil (microns) | Thickness of Boron Layers (microns) | Densities ($g/cm^3$) | Specific Moduli $(cm/sec)^2$ |
| Prior Art | | | |
| Aluminium | 0 | 2.8 | $2.6 \times 10^{11}$ |
| Titanium | 0 | 4.5 | $2.4 \times 10^{11}$ |
| Present Invention | | | |
| Aluminium (3) | 10, on one face | 2.49 | $13.5 \times 10^{11}$ |
| Aluminium (3) | 20, on one face | 2.45 | $14.2 \times 10^{11}$ |
| Titanium (3) | 10, on one face | 2.88 | $11.9 \times 10^{11}$ |
| Titanium (3) | 20, on one face | 2.67 | $13.1 \times 10^{11}$ |
| Copper (3) | 10, on one face | 3.92 | $8.3 \times 10^{11}$ |
| Copper (3) | 20, on one face | 3.26 | $9.8 \times 10^{11}$ |
| Aluminium (3) | 20, on both faces | 2.42 | $14.7 \times 10^{11}$ |
| Titanium (3) | 20, on both faces | 2.64 | $13.9 \times 10^{11}$ |
| Copper (3) | 20, on both faces | 3.21 | $10.2 \times 10^{11}$ |
| Aluminium (3) | 40, on both faces | 2.39 | $15.1 \times 10^{11}$ |
| Titanium (3) | 40, on both faces | 2.51 | $14.2 \times 10^{11}$ |
| Copper (3) | 40, on both faces | 2.82 | $10.9 \times 10^{11}$ |

Example 4

A metal foil 4 is first formed into a dome-shape as shown in FIG. 4A. The thickness of the foil is selected to be 20 microns in case of aluminium foil and 10 microns in case of titanium or copper foil. Next, a boron layer 5 is applied as shown in FIG. 4B having a thickness of 10 microns on the rear face of said metal foil 4 by means of a physical vapor deposition method. Then, said metal foil 4 is thinned to the thickness of 1–3 microns by chemical- or ion-etching as shown in FIG. 4C. Subsequently, a metal layer 6 of approximately 1–3 microns in thickness is formed by a physical vapor deposition method on the rear face of said boron layer 5, as shown by FIG. 4D, to obtain a speaker diaphragm.

Table 2 shows densities and specific moduli of the speaker diaphragms for various thicknesses of the boron layer 5 and for various kinds and thickness of metals constituting the diaphragm.

TABLE 2

| Components | | | |
|---|---|---|---|
| Thickness of Boron Layer (microns) | Kinds and Thickness of Metal Layers (microns) | Densities ($g/cm^3$) | Specific Moduli $(cm/sec)^2$ |
| 10 | Aluminium, on both faces: 1 | 2.49 | $12.1 \times 10^{11}$ |
| 10 | Titanium, on both faces: 1 | 2.78 | $11.2 \times 10^{11}$ |
| 10 | Copper, on both faces: 1 | 3.50 | $9.08 \times 10^{11}$ |
| 10 | Aluminium, on one face: 1<br>Titanium, on the other face: 1 | 2.6 | $10.7 \times 10^{11}$ |
| 10 | Titanium, on one face: 1<br>Copper, on the other face: 1 | 3.14 | $10.5 \times 10^{11}$ |
| 10 | Copper, on one face: 1<br>Aluminium, on the other face: 1 | 3.0 | $9.03 \times 10^{11}$ |
| 10 | Aluminium, on one face: 1<br>Tungsten, on the other face: 1 | 3.84 | $10.5 \times 10^{11}$ |
| 10 | Titanium, on one face: 1<br>Tungsten, on the other face: 1 | 4.02 | $11.3 \times 10^{11}$ |
| 10 | Copper, on one face: 1<br>Tungsten, on the other face: 1 | 4.38 | $9.34 \times 10^{11}$ |
| 20 | Aluminium, on both faces: 1 | 2.44 | $12.0 \times 10^{11}$ |
| 20 | Titanium, on both faces: 1 | 2.59 | $11.7 \times 10^{11}$ |
| 20 | Copper, on both faces: 1 | 2.98 | $10.2 \times 10^{11}$ |

Remark:

$$\text{Specific Modulus} = \frac{\text{Young's Modulus (E)}}{\text{Density } (\rho)}$$

Nickel or silicon can be also employed for the metals of the foil 4 and the metal layer 6 in each embodiment of the abovementioned Table 2.

Figure 4:
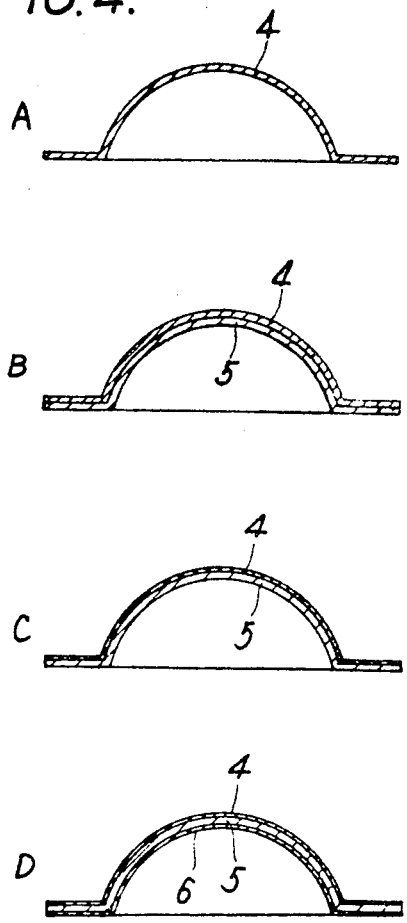

The diaphragm of the embodiment of FIG. 4 is constructed in a manner such the boron layer 5 is sandwiched between the metal foil 4 and the metal layer 6. Accordingly, water-resistivity of the diaphragm is improved and peeling off of the boron layer 5 from the metal foil 4 is prevented.

Figure 5:
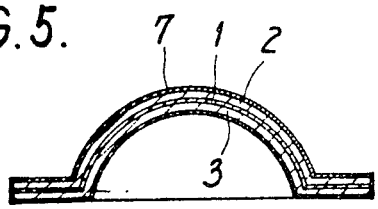

In order to prevent deterioration of the characteristics of the speaker diaphragms with the lapse of time, it is desirable to coat the surface of each speaker diaphragm of the abovementioned Examples with a resin (e.g. epoxy, urethane or the like resin) exhibiting good water-resistivity and adhesiveness, to a thickness of approximately 2–3 microns by means of any known method, e.g. spraying. One example of a speaker diaphragm coated with the resin layer is shown in FIG. 5, wherein numeral 7 designates the bottom, top and side resin layer applied on the whole face of the diaphragm of the type shown in FIG. 3.

As elucidated in the foregoing description, the present invention can provide a speaker diaphragm light in weight as well as having a high specific modulus.

What is claimed is:

1. A method of forming a light weight, high-efficiency high-frequency speaker diaphram internally mechanically resistant against vibration and having a high specific modulus, said method comprising the successive steps of:

(1) forming a foil of aluminum, titanium and copper into the shape of a dome;

(2) applying a layer of boron to one face of said metal dome by an ion-plating, cathode sputtering or vacuum evaporation physical vapor deposition process;

(3) reducing the thickness of the metal foil portion of said boron-coated dome by chemically etching away a portion of said metal until the metal foil portion is substantially smaller in thickness while reducing the weight of said boron-coated dome and increasing the specific modulus thereof;

(4) applying a second layer of boron to the other face of said metal dome;

the resulting composite high-energy, high-frequency speaker diaphram consisting substantially of said boron layers.

2. The method as claimed in claim 1 wherein each of the boron layers is at least 10 microns in thickness.

3. The method as claimed in claim 1 or 2 wherein the metal foil is thinned in step (3) to a thickness of from about 1 to about 3 microns.

4. A method of forming a light weight, high-efficiency thin metal speaker diaphram internally mechanically resistant against vibration and having a high specific modulus, said method comprising successive steps of:

(1) forming a metal foil into the shape of a dome;

(2) applying a layer of boron to one face of said metal dome by an ion-plating, cathode sputtering or vacuum evaporation physical vapor deposition process to form a uniform boron layer on said dome, and (3) reducing the thickness of the boron-coated metal dome of step (2) by chemically etching away a portion of said metal thus reducing the weight of said boron-coated dome and increasing the specific modulus thereof, the resulting composite high-efficiency speaker diaphram consisting substantially of said boron layer.

5. The method as claimed in claim 4 including the additional step of:

(4) applying a second layer of boron to the other face of said metal dome using said physical vapor deposition process.

6. The method as claimed in claim 4 wherein the metal dome is reduced in thickness in step (3) to the extent of from about 1 to about 3 microns.

7. The method as claimed in claim 4 or 5 wherein said boron layer is at least 10 microns in thickness.

8. The method as claimed in claim 4 wherein the resulting speaker diaphram has a density in the range of between about 2.45 and 3.92 g/cm$^3$.

9. The method as claimed in claim 4 or 8 wherein the resulting speaker diaphram has a specific modulus in the range of about 8.3 to about $14.2\times10^{11}$ (cm/sec)$^2$.

10. The method as claimed in claim 1 or 5 wherein the resulting speaker diaphram has a density in the range of between about 2.42 and about 3.21 g/cm$^3$.

11. The method as claimed in claim 1 or 5 wherein the resulting speaker diaphram has a specific modulus in the range of about 10.2 to about $15.1\times10^{11}$ (cm/sec)$^2$.

12. The method as claimed in claim 4 or 5 wherein the metal foil is aluminum, titanium or copper.

13. A method of forming a light weight, high-efficiency thin metal speaker diaphram internally mechanically resistant against vibration and having a high specific modulus, said method comrpising the successive steps of:

(1) forming a metal foil into the shape of a dome;

(2) applying a layer of boron to one face of said metal dome by an ion-plating, cathode sputtering or vacuum evaporation physical vapor deposition process to form a uniform boron layer on said dome;

(3) etching and reducing the thickness of the boron-coated metal dome of step (2) by chemically etching away the exposed portion of said metal, thus reducing the weight of said boron-coated dome and increasing the specific modulus thereof; and (4) applying a layer of aluminum, titanium, copper or tungsten metal to the boron-coated surface, producing a composite metal/boron/metal high-efficiency speaker diaphram.

14. The method as claimed in claim 13 wherein said metal foil is aluminum, titanium or copper.

15. The method as claimed in claim 13 wherein metal foil of step (1) has a thickness of from about 10 to about 20 microns.

16. The method as claimed in claim 13 or 15 wherein said metal foil etched in step (3) is reduced to a thickness of about 1 to about 3 microns.

17. The method as claimed in claim 16 wherein the applied boron layer is at least about 10 microns in thickness.

18. The method as claimed in claim 16 wherein the metal layer applied in step (4) is about 1 to about 3 microns in thickness.

19. The method as claimed in claim 13 or 14 wherein the resulting speaker diaphram has a density in the range of between about 2.44 and about 4.39 g/cm$^3$.

20. The method as claimed in claim 13 or 14 wherein the resulting speaker diaphram has a specific modulus in the range of about 9.03 to about $12.1\times10^{11}$ (cm/sec)$^2$.

21. The light weight, high-efficiency metal/boron/-metal speaker diaphram produced by the method of claim 14.

22. A method of forming a light weight, high-efficiency high-frequency speaker diaphram internally mechanically resistant against vibration and having a high specific modulus, said method against vibration and having a high specific modulus, said method comprising the successive steps of:

(1) forming metal foil into the shape of a dome;

(2) reducing the thickness of the metal dome by chemically etching away a portion of the metal thus reducing the weight of the dome; and (3) applying a layer of boron to one face of the etched metal dome of step (2) by an ion-plating, cathode sputtering or vacuum evaporation physical vapor deposition to form a uniform layer of boron on said dome.

23. The method as claimed in claim 22 including the additional step of:

(4) applying a second layer of boron to the other face of said metal dome using said physical vapor deposition process.

24. The method as claimed in claim 22 or 23 wherein the metal foil in step (2) is reduced to a thickness of about 5 to about 6 microns.

25. The method as claimed in claim 22 or 23 wherein the boron layer applied has a thickness of at least 10 microns.

26. The method according to claim 22 or 23 wherein said metal foil is aluminum, titanium or copper.

27. The method according to claim 1, 4, 13 or 22 including the additional step of applying a water resistant polymeric resin coating to the surfaces of thus formed metal speaker diaphram.

28. The method according to claim 27 wherein said resin is applied to a thickness of about 2 to about 3 microns.

* * * * *